US011998854B1

(12) United States Patent
Schmit

(10) Patent No.: US 11,998,854 B1
(45) Date of Patent: Jun. 4, 2024

(54) LOW-FRICTION RECREATIONAL SLIDE SYSTEM

(71) Applicant: Slick Slide LLC, Phoenix, AZ (US)

(72) Inventor: Gary Schmit, Phoenix, AZ (US)

(73) Assignee: Slick Slide LLC, Phoenix, AZ (US)

( * ) Notice: Subject to any disclaimer, the term of this patent is extended or adjusted under 35 U.S.C. 154(b) by 0 days.

(21) Appl. No.: 18/349,347

(22) Filed: Jul. 10, 2023

Related U.S. Application Data

(60) Provisional application No. 63/381,818, filed on Nov. 1, 2022.

(51) Int. Cl.

| | |
|---|---|
| ***A63G 21/02*** | (2006.01) |
| ***C10M 107/38*** | (2006.01) |
| ***C10M 107/50*** | (2006.01) |
| ***C10M 125/04*** | (2006.01) |
| ***C10M 169/04*** | (2006.01) |
| *C10N 50/00* | (2006.01) |

(52) U.S. Cl.
CPC ..... *A63G 21/02* (2013.01); *C10M 107/38* (2013.01); *C10M 107/50* (2013.01); *C10M 125/04* (2013.01); *C10M 169/04* (2013.01); *C10M 2201/05* (2013.01); *C10M 2213/0623* (2013.01); *C10M 2229/0475* (2013.01); *C10N 2050/023* (2020.05)

(58) Field of Classification Search
CPC ... A63G 21/02; C10M 107/38; C10M 107/50; C10M 125/04; C10M 169/04; C10M 2201/05; C10M 2213/0623; C10M 2229/0475; C10N 2050/023
USPC ..... 472/88
See application file for complete search history.

(56) References Cited

U.S. PATENT DOCUMENTS 3,140,878 A 7/1964 Davis
4,886,725 A 12/1989 Tanaka et al.
(Continued)

FOREIGN PATENT DOCUMENTS

DE 202007006829 U1 8/2007
JP S4846776 U 6/1973
(Continued)

OTHER PUBLICATIONS

Europeaen Patent Office, International Search Report and Written Opinion of the International Searching Authority, International Application No. PCT/US2023/069866, dated Oct. 17, 2023 (17 pages).
(Continued)

*Primary Examiner* — Prem C Singh
*Assistant Examiner* — Francis C Campanell
(74) *Attorney, Agent, or Firm* — Wood Herron & Evans LLP

(57) ABSTRACT

A recreational slide system is provided. The recreational slide system includes a slide and a ride vehicle configured to support a rider down the slide. The slide includes a slide body with a non-wet lubricated slide surface that extends between a top entrance of the slide and a bottom exit of the slide. The ride vehicle includes a fabric layer that forms a top surface configured to contact the rider and a mesh layer that forms a bottom surface configured to contact the slide
(Continued)

surface. The coefficient of friction between the mesh layer of the ride vehicle and the non-wet lubricated slide surface is within a range of between about 0.03 to about 0.2.

28 Claims, 6 Drawing Sheets

(56) References Cited

U.S. PATENT DOCUMENTS

| | | | | |
|---|---|---|---|---|
| 5,246,401 | A | 9/1993 | Boatwright | |
| 5,427,698 | A * | 6/1995 | Hirokawa | C10M 169/044 508/106 |
| 5,893,570 | A | 4/1999 | Kehrmann | |
| 6,142,879 | A | 11/2000 | Phillips | |
| 6,908,351 | B2 | 6/2005 | Burke | |
| 7,250,009 | B2 | 7/2007 | Weber | |
| 7,431,982 | B2 | 10/2008 | Sasao et al. | |
| 9,486,711 | B2 | 11/2016 | Brassard et al. | |
| 9,861,220 | B2 | 1/2018 | Burkhalter | |
| 10,119,094 | B2 | 11/2018 | Barth et al. | |
| 10,549,502 | B2 | 2/2020 | Berrang | |
| 11,352,101 | B2 | 6/2022 | Osborn et al. | |
| D973,821 | S | 12/2022 | Schmit | |
| D1,003,382 | S | 10/2023 | Schmit | |
| 2007/0082790 | A1 | 4/2007 | Siebert | |
| 2007/0225178 | A1 | 9/2007 | Sawyer et al. | |
| 2009/0105000 | A1 | 4/2009 | Scarborough | |
| 2014/0295140 | A1 | 10/2014 | King et al. | |
| 2014/0357387 | A1 | 12/2014 | Murphy | |
| 2015/0314203 | A1 | 11/2015 | Hunter | |
| 2016/0168805 | A1 * | 6/2016 | Schumann | D03D 13/004 280/18 |
| 2017/0072253 | A1 | 3/2017 | Tsai | |
| 2018/0054227 | A1 | 2/2018 | Wolf | |
| 2023/0129814 | A1 * | 3/2023 | Fallgatter | |

FOREIGN PATENT DOCUMENTS

| | | | | |
|---|---|---|---|---|
| JP | H0717293 | U | 3/1995 | |
| JP | 2000141544 | A | 5/2000 | |
| KR | 101882747 | B1 | 8/2018 | |
| WO | 0046487 | A1 | 8/2000 | |
| WO | 2023069789 | A2 | 4/2023 | |
| WO | WO-2023069789 | A2 * | 4/2023 | A63G 21/02 |

OTHER PUBLICATIONS

Intellectual Property Office, Patents Act 1977: Search Report under Section 17, Application No. GB2314317.5, dated Oct. 16, 2023 (1 page).

Intellectual Property Office, Patents Act 1977, Combined Search and Examination Report under Sections 17 & 18(3), Application No. GB2314317.5, dated Oct. 17, 2023 (3 pages).

UK Intellectual Property Office, Patents Act 1977: Observations under Section 21, Letter to Applicant's counsel from UK IPO, regarding observations received from a third party in Application No. GB23143715.5, dated Feb. 23, 2024 (1 page).

UK Intellectual Property Office, Observation under Section 21 from a Third Party regarding UK Application No. GB2314317.5, Observation submitted: cover email to UK Intellectual Property Office, regarding Urgent Oberservations Under Section 21 UKPA, submitted by Third Party on Feb. 21, 2024 (6 pages).

UK Intellectual Property Office, Observation under Section 21 from a Third Party regarding UK Application No. GB2314317.5, Observation submitted: email regarding 6 person wipeout, email dated Mar. 3, 2019 (1 page).

UK Intellectual Property Office, Observation under Section 21 from a Third Party regarding UK Application No. GB2314317.5, 6 Man Meltdown Cage Attachment, submitted by Third Party on Feb. 21, 2024 (6 pages).

UK Intellectual Property Office, Observation under Section 21 from a Third Party regarding UK Application No. GB2314317.5, Slick Slide Co Intro Attachment, submitted by Third Party on Feb. 21, 2024 (12 pages)

UK Intellectual Property Office, Observation under Section 21 from a Third Party regarding UK Application No. GB2314317.5, Observation submitted: Second email to UK Intellectual Property Office reagrding Urgent Observaztions Under Section 21 UKPA, submitted by Third Party on Feb. 22, 2024 (7 pages).

UK Intellectual Property Office, Patents Act 1977: Observations under Section 21 from a third party regarding Application No. GB2314317.5, Reply email from IPO, acknowledging receipt of observations, email dated Feb. 22, 2024 (1 page).

UK Intellectual Property Office, Patents Act 1977, Application No. GB2314317.5, dated Mar. 6, 2024 (2 pages).

Intellectual Property Office, Patents Act 1977, Combined Search and Examination Report under Sections 17 & 18(3), Application No. GB2401780.8, dated Mar. 6, 2024 (4 pages).

* cited by examiner

LOW-FRICTION RECREATIONAL SLIDE SYSTEM

CROSS-REFERENCE TO RELATED APPLICATION

The present application claims the filing benefit of U.S. Provisional Application Ser. No. 63/381,818, filed Nov. 1, 2022, the disclosure of which is incorporated herein by reference in its entirety.

TECHNICAL FIELD

The present invention relates generally to recreational slides and, more particularly, to a slide system including a ride vehicle for use with a recreational slide having a slide surface provided with a dry lubricant material.

BACKGROUND

Recreational slides, such as dry slides and water slides, provide a popular form of entertainment activity. In that regard, conventional dry or water slides include a slide surface down which a rider descends (i.e., slides) for entertainment. The speed at which the rider descends down the slide is often determinative of the level of entertainment experienced by the rider. For most riders, a fast slide speed (i.e., a fast rate of descent down the slide) is more thrilling compared to a slow slide speed (i.e., a slow rate of descent down the slide), and therefore is more desirable. To this end, maintaining a low coefficient of friction between the rider or a ride vehicle that supports the rider and the slide surface provides for a fast and exciting slide.

There is a notable difference in slide speed between a water slide and a dry slide. In particular, water slides are faster as a result of water flow down the slide surface, which in some cases can propel the rider down the slide. Further, the water flow lubricates the slide surface which reduces the coefficient of friction between the rider or any ride vehicle being used and the slide surface. To this end, the coefficient of friction between a rider (or ride vehicle) and the slide surface of a water slide may be within a range of between 0.05 to 0.2, and is typically about 0.1.

A dry slide is considered to be any slide that is free of any fluid or wet lubricant flowing down the slide surface and between a rider or the ride vehicle and the slide surface. A dry slide, as a result of not having a flow of lubricant down the slide surface, typically cannot generate the same slide speed as a same-sized water slide. The coefficient of friction between a rider (or ride vehicle) and the slide surface of a typical dry slide is often within a range of between 0.15 to 0.3, and is typically about 0.25. Furthermore, dry slides are often indoor installations so that they can be used year-round. To that end, height restrictions imposed by the ceiling of a building in which the slide is installed necessitate slides having a shorter height, which can further limit the slide speed of a rider.

Thus, there is a need for a dry recreational slide system that can achieve slide speeds equivalent to, or better than, a water slide for the same or similar sized slide. In particular, it is desirable to achieve improved slide speeds for dry slides without the use of a flow of fluid down the slide surface that flows between the rider and/or the ride vehicle.

SUMMARY

According to an embodiment to the present invention, a recreational slide system is provided. The recreational slide system includes a slide and a ride vehicle configured to support a rider down the slide. The slide includes a slide body with a non-wet lubricated slide surface that extends between a top entrance of the slide and a bottom exit of the slide. The ride vehicle includes a fabric layer that forms a top surface configured to contact the rider and a mesh layer that forms a bottom surface configured to contact the slide surface. The coefficient of friction between the mesh layer of the ride vehicle and the non-wet lubricated slide surface may be within a range of between about 0.03 to about 0.2, and particularly within a range of between about 0.05 to about 0.12. In one aspect, the coefficient of friction is in terms of kinetic coefficient of friction.

According to one aspect of the present invention, the slide surface may include a dry lubricant material. For example, the dry lubricant material may comprise a dry lubricant coating over the slide surface. In one aspect, the dry lubricant coating includes a thickness that is within a range of between about 1 micron to about 5 micron. According to another aspect of the present invention, the slide body includes a base wall and a pair of sidewalls and the dry lubricant coating may cover a sliding surface of the base wall. The dry lubricant coating may further cover at least a portion of a sliding surface of the pair of sidewalls.

According to yet another aspect of the present invention, the dry lubricant material may include a resin, a lubricant, a thermal conductor, and a hardener. In particular, the dry lubricant material may include 20% to 30% by weight of the resin, 30% to 50% by weight of the lubricant, 1% to 5% by weight of the thermal conductor, and 20% to 30% by weight of the hardener. For instance, the resin may be a silicon-based epoxy resin. Additionally, the lubricant may be polytetrafluoroethylene. In one aspect, the thermal conductor may be copper. In another aspect, the hardener may be an anhydride-based or an amine-based catalyst.

According to one aspect of the present invention, the mesh layer of the ride vehicle may include a weave of threads formed of monofilament synthetic fibers. For instance, the monofilament synthetic fibers may be a polyamide monofilament structure such as Nylon. In one aspect, the weave of threads may include a plurality of weft threads each having a thread diameter within a range of between 0.1 mm to 0.6 mm and a plurality of warp threads each having a thread diameter within a range of between about 0.1 mm to about 0.6 mm. In yet another aspect, the plurality of warp threads may extend along the ride vehicle in a lengthwise direction and the plurality of weft threads may extend along the ride vehicle in a widthwise direction. In one aspect, the mesh layer may include a plurality of interstitial openings that define an open area of the mesh layer. The open area of the mesh layer may be within a range of between about 35% to about 50%.

According to another embodiment of the present invention, a non-wet lubricated recreational slide is provided. The recreational slide includes a slide body with a slide surface that extends between a top entrance of the slide and a bottom exit of the slide. The slide surface includes a dry lubricant coating that comprises a resin, a lubricant, a thermal conductor, and a hardener. According to one aspect of the present invention, the dry lubricant coating includes 20% to 30% by weight of the resin, 30% to 50% by weight of the lubricant, 1% to 5% by weight of the thermal conductor, and 20% to 30% by weight of the hardener. According to another aspect, the slide body includes a base wall and a pair of sidewalls, and the dry lubricant coating may cover a sliding surface of the base wall. In yet another aspect, the dry lubricant coating may cover at least a portion of a sliding surface of the pair of sidewalls.

According to another embodiment of the present invention, a ride vehicle configured to support a rider down a non-wet lubricated recreational slide is provided. The ride vehicle includes an elongate body that extends between a first end and an opposite second end. The body includes a central core positioned between a fabric layer that forms a top surface of the ride vehicle that is configured to contact the rider and a woven mesh layer that forms a bottom surface of the ride vehicle that is configured to contact the non-wet lubricated recreational slide. The ride vehicle further includes a pair of handles attached to the fabric layer adjacent the first end of the ride vehicle.

According to one aspect of the present invention, the woven mesh layer includes a weave of threads formed of monofilament synthetic fibers. For example, the monofilament synthetic fibers may be a polyamide monofilament structure such as Nylon, and preferably Nylon 6 (polycaprolactam). In another aspect, the mesh layer includes a plurality of interstitial openings that define an open area of the mesh layer. For example, the open area of the mesh layer may be within a range of between about 35% to about 50%. In yet another aspect, the mesh layer includes a plurality of weft threads each having a thread diameter within a range of between 0.1 mm to 0.6 mm and a plurality of warp threads each having a thread diameter within a range of between about 0.1 mm to about 0.6 mm. In one aspect, the central core is surrounded by a fabric liner that is positioned between the central core and the fabric layer and the woven mesh layer.

Various additional features and advantages of the invention will become more apparent to those of ordinary skill in the art upon review of the following detailed description of one or more illustrative embodiments taken in conjunction with the accompanying drawings.

BRIEF DESCRIPTION OF THE DRAWINGS

The accompanying drawings, which are incorporated in and constitute a part of this specification, illustrate one or more embodiments of the invention and, together with the general description given above and the detailed description given below, serve to describe the one or more embodiments of the invention.

DETAILED DESCRIPTION

Embodiments of the present invention are directed to a slide system that includes a dry recreational slide, otherwise referred to as a non-wet lubricated slide, and a ride vehicle that includes a mesh material configured to be positioned between a rider and a slide surface of the slide for sliding down the slide. In one embodiment, the slide surface of the slide includes a dry lubricant material in the form of a coating that cooperates with the mesh material of the ride vehicle to achieve a low coefficient of friction therebetween. The mesh material may form part of an article of clothing, for example, or the ride vehicle may be configured to support a rider as they descend down the slide. In that regard, as a rider descends down the slide, the mesh material is in contact with the slide surface, and more particularly the dry lubricant material of the slide surface, such that a coefficient of friction at interfaces between surfaces of the mesh material and the slide surface is within a range of between about 0.03 to about 0.2, and particularly within a range of between about 0.05 to about 0.12, depending on factors such as a weight of the rider, for example. As used herein relative to the coefficient of friction, "about" is intended to mean+/−10%. These and other aspects of the present invention will be described in further detail below.

As will be understood by a person skilled in the art, the coefficient of friction between the ride vehicle and the slide surface is the ratio of the frictional force between two surfaces to the normal force pressing the surfaces together. That is, Coefficient of Friction (p)=Force of Friction (F)/Normal Force (N). The coefficient of friction between the surfaces of the mesh material and the slide surface may be described in terms of both the static and kinetic coefficients of friction.

Figure 1:
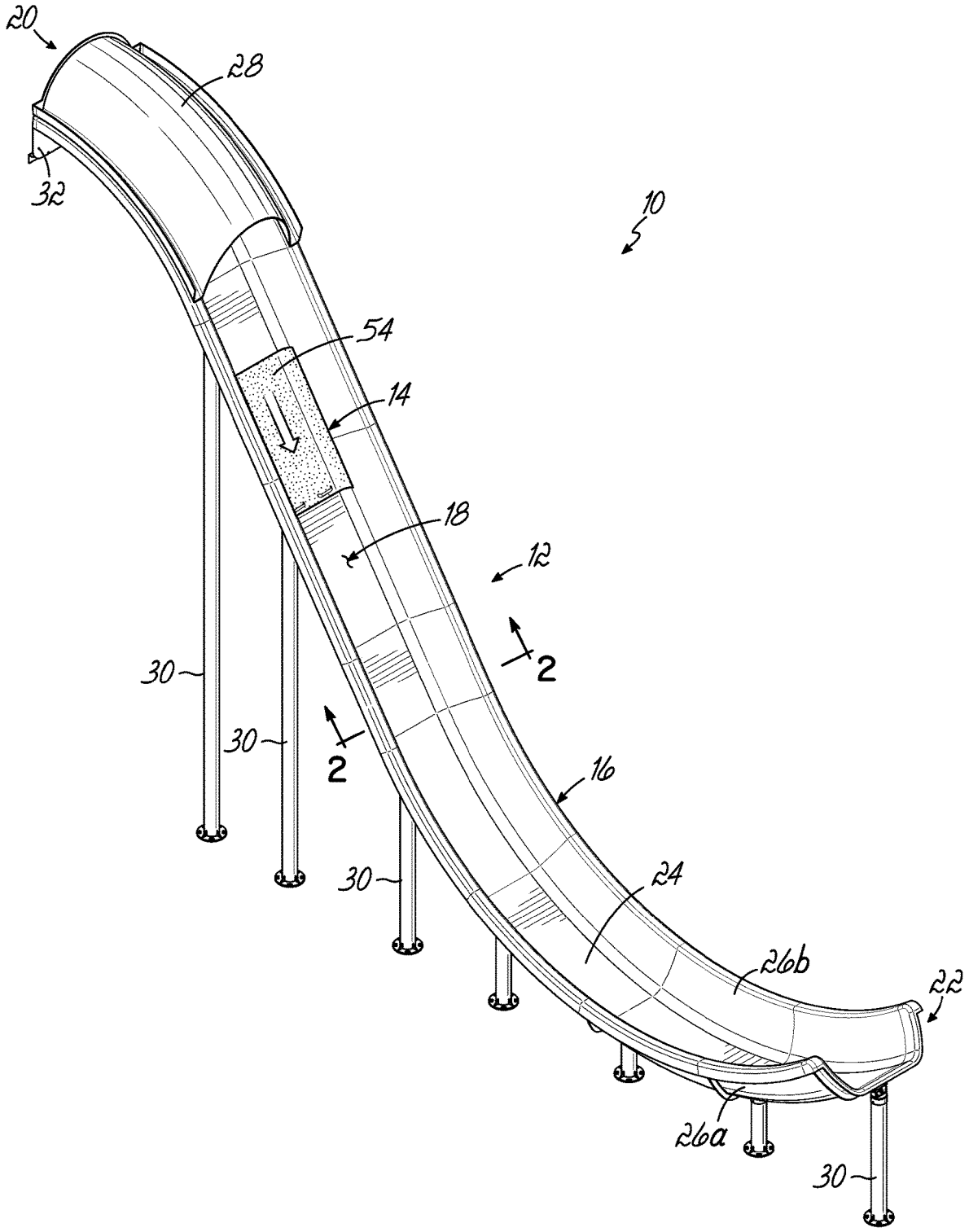
FIG. 1 is a perspective view of a slide system including a ride vehicle and a dry slide having a slide surface provided with a dry lubricant surface coating over which a rider supported on the ride vehicle is configured to slide according to an embodiment of the present invention.

Referring now to the figures, FIG. 1 illustrates a slide system 10 including an exemplary non-wet lubricated (i.e., dry lubricated) recreational slide 12 and a ride vehicle 14 configured to be positioned between a rider and surfaces of the slide 12 for sliding down the slide 12. In that regard, the slide 12 includes a slide body 16 that defines a slide surface 18. The slide body 16 may be formed of a fiber-reinforced plastic (FRP), such as fiberglass, for example. However, the slide body 16 may be formed of other suitable materials such as Ultra-High-Molecular-Weight Polyethylene (UHMWPE), High-Density Polyethylene (HDPE), or other type of thermoplastic material, for example. In the embodiment shown, the slide body 16 further includes a dry lubricant material to improve the lubricity of the slide surface 18, as will be described in further detail below. By non-wet lubricated, it is meant that the slide body 16, and more particularly the slide surface 18, is free of any fluid or wet lubricant flowing down the slide surface 18 and between a rider or the ride vehicle 14 and the slide surface 18. To this end, the recreational slide 12 is not a water slide. However, the slide surface 18 may be periodically conditioned with oil, such as silicone oil, for example, as part of on-going maintenance of the recreational slide 12. However, while aspects of the present invention are shown and described in the context of a certain type or configuration of slide, it will be understood that the same inventive concepts, and particularly those related to aspects of the dry lubricant material on the slide surface 18 and the ride vehicle 14, may be implemented with different non-wet lubricated slide designs. To this end, the drawings are not intended to be limiting.

With continued reference to FIG. 1, the slide 12 includes the slide body 16 which extends between a top entrance 20 of the slide 12 to an opposite bottom exit 22 to define a length of the slide 12. The slide body 16 forms a chute that is generally defined by a base wall 24 and a pair of opposite sidewalls 26*a*, 26*b*. As shown, the base wall 24 generally defines the slide surface 18 down which a rider may slide. The sidewalls 26*a*, 26*b* serve to contain the rider within the slide 12 as the rider travels down the slide 12 along the slide surface 18 and may also form part of the slide surface 18. The slide 12 may further include a cover 28 attached to the body 16 of the slide 12 near the top entrance 20. The cover 28 cooperates with the slide body 16 to form a tunnel through which a rider passes as the rider enters the slide 12 at the top entrance 20 and begins to descend down the slide 12. The slide 12 may further include a plurality of supports 30 configured to support the slide 12 above a mount surface to which the supports 30 are attached, such as a cement floor, for example. The slide 12 may also include a mounting flange 32 at the top entrance 20 of the slide 12 that is configured to secure the slide 12 to a ladder structure used by riders to access the slide 12, for example.

In use, a rider enters the slide 12 via the top entrance 20, travels down the slide body 16 along the slide surface 18, and subsequently exits the slide 12 at the bottom exit 22. In particular, the rider rides down the slide 12 on the ride vehicle 14 which is configured to be positioned between the slide surface 18 and the rider. As will be described in further detail below, the ride vehicle 14 includes a mesh material that cooperates with the slide surface 18 to achieve an improved, i.e., reduced, coefficient of friction therebetween. The resultant coefficient of between the mesh material of the ride vehicle 14 and the slide surface 18 may be within a range of between about 0.03 to about 0.2, and particularly within a range of between about 0.05 to about 0.12, and in particular about 0.09, and therefore provides the rider with a fast rate of descent down the slide 12 (i.e., speed). As a result of the increased rate of descent down the slide 12, the rider may be launched from the bottom exit 22 of the slide 12 and into the air for aerial play before landing in a designated landing area (i.e., foam pad, inflatable pad, etc.). While the slide 12 may be ridden by a rider using their body alone, the coefficient of friction between the rider and the slide surface 18 will be higher compared to that when using the ride vehicle 14. As a result, the speed that the rider travels down the slide 12 will be slower.

Figure 2A:
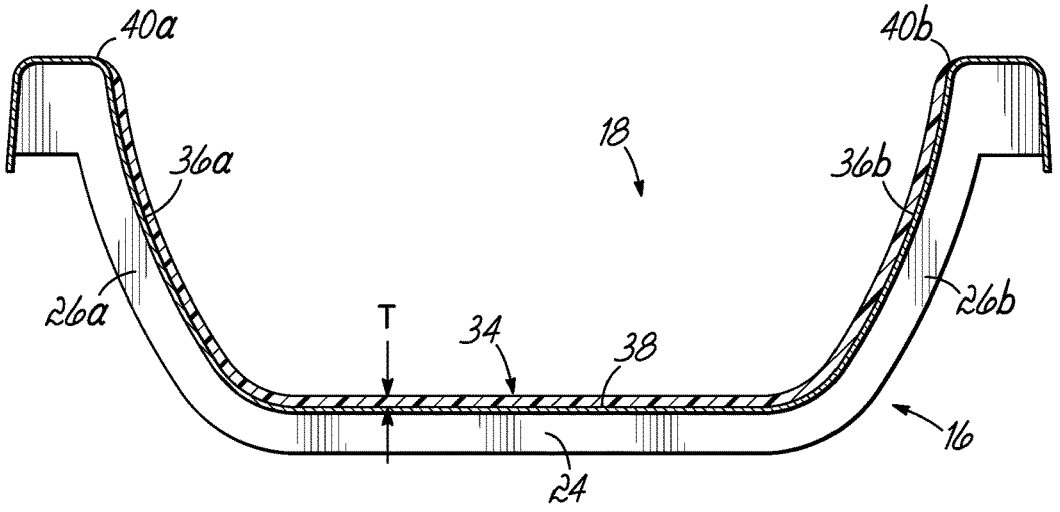
FIG. 2A is a cross section taken along line 2-2 of FIG. 1, diagrammatically illustrating details of a dry lubricant coating of the slide surface in accordance with a first embodiment of the invention.
Figure 2B:
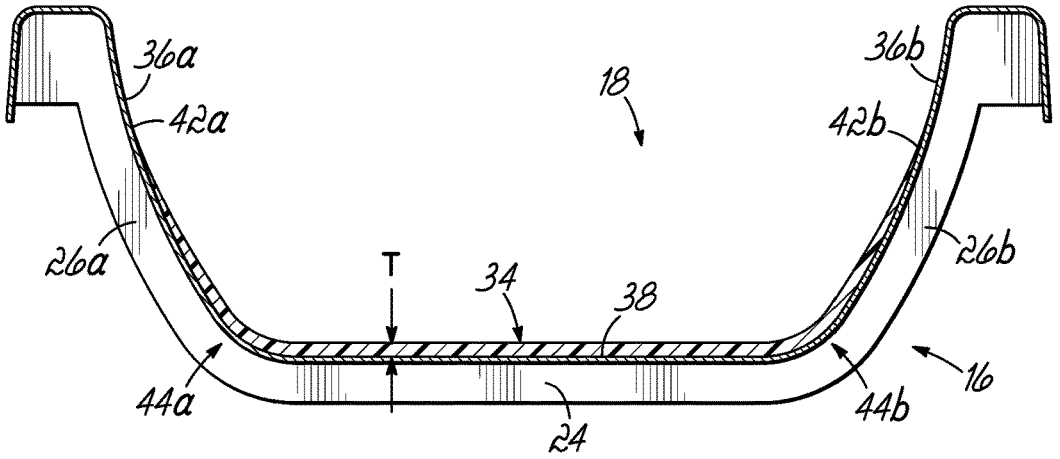
FIG. 2B is a cross section taken along line 2-2 of FIG. 1, diagrammatically illustrating details of a dry lubricant coating of the slide surface in accordance with a second embodiment of the invention.
Figure 2C:
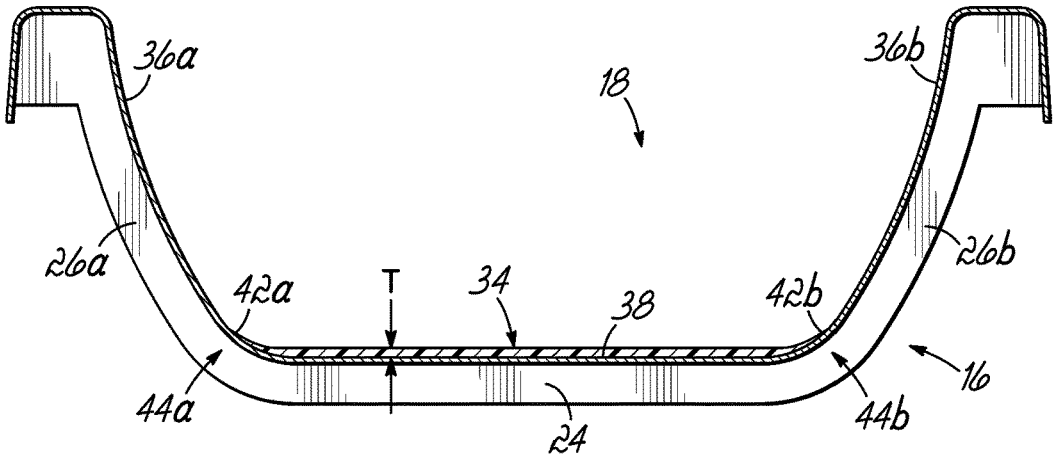
FIG. 2C is a cross section taken along line 2-2 of FIG. 1, diagrammatically illustrating details of a dry lubricant coating of the slide surface in accordance with a third embodiment of the invention.

With reference to FIGS. 2A-2C, details of the slide surface 18 will now be described in accordance with embodiments of the present invention. In that regard, the slide surface 18 includes a dry lubricant material provided as a coating 34 that is applied to the slide body 16 along the entire length of the slide surface 18 (i.e., between the top entrance 20 of the slide 12 to the bottom exit 22). In an alternative embodiment, only a portion of the slide surface 18, such as the top half or the bottom half of the slide surface 18, may include the dry lubricant coating 34. In another embodiment, the slide surface 18 may not have a dry lubricant coating 34. If there is no coating, the coefficient of friction between the ride vehicle 14 and the uncoated slide surface 18 will be higher. This means that the rider will travel down the slide 12 at a slower speed than if the slide surface 18 included the dry lubricant coating 34.

With reference to FIG. 2A, which illustrates a cross-section of the slide 12 taken along line 2-2 of FIG. 1, the dry lubricant coating 34 is shown in accordance with a first embodiment of the invention. In that regard, the dry lubricant coating 34 is applied as a permanent coating to the slide body 16 to cover a sliding surface 36*a*, 36*b* of both sidewalls 26*a*, 26*b*, respectively, and a sliding surface 38 of the base wall 24. The sliding surfaces 36*a*, 36*b*, 38 may collectively define the slide surface 18. In the embodiment shown, the dry lubricant coating 34 covers substantially the entirety of the sliding surface 36*a*, 36*b*, 38 of each sidewall 26*a*, 26*b* and the base wall 24. That way, any contact between the ride vehicle 14 and the slide body 16 is with the coated surfaces 36*a*, 36*b*, 38 of the slide body 18 to yield a coefficient of friction therebetween that is within a range of between about 0.03 to about 0.2, and particularly within a range of between about 0.05 to about 0.12, as described in further detail below.

With continued reference to FIG. 2A, the dry lubricant coating 34 includes a thickness T which may be substantially constant over at least the sliding surface 38 of the base wall 24. The thickness T of the dry lubricant coating 34 may be within a range of between about 1 micron to about 5 micron, and more particularly within a range of between about 2 micron to about 3 micron. As used herein relative to the thickness T of the dry lubricant coating 34, "about" is intended to mean+/−10%. However, the thickness T of the dry lubricant coating 34 may taper along each sidewall sliding surface 36*a*, 36*b*, as shown. In particular, the thickness T of the dry lubricant coating 34 may taper from the base wall 24 toward an edge 40*a*, 40*b* of each sidewall 26*a*, 26*b*, as shown.

FIG. 2B illustrates the dry lubricant coating 34 in accordance with a second embodiment of the invention. In that regard, the dry lubricant coating 34 includes a thickness T which may be substantially constant over the sliding surface 38 of the base wall 24. Furthermore, the thickness T of the dry lubricant coating 34 may taper along the sidewall sliding surfaces 36*a*, 36*b* to a terminal edge 42*a*, 42*b* along each sidewall 26*a*, 26*b*, respectively. As shown, the thickness T of the dry lubricant coating 34 may taper from the base wall 24 toward the terminal edge 42*a*, 42*b* along each sidewall 26*a*, 26*b*. The thickness T of the dry lubricant coating 34 may be within a range of between about 1 micron to about 5 micron, and more particularly within a range of between about 2 micron to about 3 micron. The sliding surface 36*a*, 36*b* of each sidewall 26*a*, 26*b* defines a surface height measured between the edge 40*a*, 40*b* of each sidewall 26*a*, 26*b* and a respective transition 44*a*, 44*b* between each sidewall 26*a*, 26*b* and the base wall 24. In the embodiment shown, each terminal edge 42*a*, 42*b* of the dry lubricant coating 34 may be located at a midpoint along the sliding surface 36*a*, 36*b* of each sidewall 26*a*, 26*b*, for example. Stated differently, the dry lubricant coating 34 extends upwardly from the base wall 24 of the slide 12 to cover approximately 50% of the of the sliding surface 36*a*, 36*b* of each sidewall 26*a*, 26*b*. However, in alternative embodiments, each terminal edge 42*a*, 42*b* of the dry lubricant coating 34 may extend upwardly from the base wall 24 to cover any amount of the of the sliding surface 36*a*, 36*b* of each sidewall 26*a*, 26*b*, for example.

FIG. 2C illustrates the dry lubricant coating 34 in accordance with a third embodiment of the invention. In that regard, the dry lubricant coating 34 includes a thickness T which may taper along the sliding surface 38 of the base wall 24 to a terminal edge 42*a*, 42*b* located at each transition 44*a*, 44*b* between the base wall 24 and each sidewall 26*a*, 26*b*. The thickness T of the dry lubricant coating 34 may be within a range of between about 1 micron to about 5 micron, and more particularly within a range of between about 2 micron to about 3 micron. To this end, the dry lubricant coating 34 only covers the sliding surface 38 of the base wall 24 of the slide 12.

According to embodiments of the present invention, the dry lubricant material is an anti-friction or friction reducing material in the form of a dry lubricant coating 34 on the slide surface 18 of the slide 12. In that regard, the formulation for the dry lubricant material that is applied to the slide is a mixture comprising the following: (i) a resin, (ii) a lubricant, (iii) a thermal conductor, and (iv) a hardener, otherwise referred to as a hardening or curing agent. In one embodiment, the dry lubricant material may include a pigment to change a color of the dry lubricant material to match or to be different from a color of the slide body 16, for example. In the embodiment shown, the resin is an epoxy (i.e., epoxide) resin such as Steelflex Epoxy #9X commercially available from Fasco Epoxies Inc (Fort Pierce, FL), for example. In another embodiment, the resin may be a silicone based epoxy polymeric material such as Wearlon-A (e.g., a mixture or blend of epoxy silicone emulsion, 2-propoxyethanol, water, and clay filler) or a PTFE based epoxy material such as Wearlon-B (e.g., a mixture or blend of polyethylene polyamine adduct, 2-propoxyethanol, methyl alcohol, water, and epoxy polytetrafluoroethylene emulsion), both of which are commercially available from Plastic Maritime Corporation (Wilton, NY). To this end, the resin may include silicone or polytetrafluoroethylene (PTFE). In an alternative embodiment, the resin may be a polyester based resin or a polyvinylfluoride based resin, for example.

The lubricity of the dry coating 34 and the resulting coefficient of friction between the slide surface 18 and the ride vehicle 14 is primarily influenced by the lubricant present in the dry lubricant material. In the embodiment shown, the lubricant is a solid (i.e., powderized) lubricant such as PTFE. The lubricant may alternatively be silicone (i.e., powderized). However, the lubricant may be any suitable solid lubricant such as graphite, silicone wax, molybdenum disulfide, or a solid hydrocarbon wax such as polyolefin wax, for example, or a mixture of solid lubricants. To this end, the lubricant is mixed into the resin described above to increase the amount of lubricant in the coating material. The effect of the lubricant on the lubricity of the dry lubricant coating 34 is attributed to the lamellar structure of the polymers which allows the macro molecules of PTFE or silicone, for example, to slip easily along each other. In some circumstances, such as for silicone, for example, the low-friction characteristics may be attributed to a layered structure on the molecular level and the weak bonding between layers. In any event, the powderized lubricant is mixed or blended with a solvent carrier, such as acetone, to then be mixed with the resin, as will be described in further detail below. However, the carrier may be any other suitable material that can be later removed from the dry lubricant material, such as by evaporation, for example.

The thermal conductor provides the dry lubricant material and thus the coating 34 with improved heat dissipation which also influences the coefficient of friction between the sliding surface 18 and the ride vehicle 14. In that regard, the thermal conductor improves heat absorption and heat transfer away from the sliding surface 18 of the slide 12 that is in contact with the ride vehicle 14. The resultant effect is an improved (i.e., reduced) and consistent coefficient of friction between the sliding surface 18 and the ride vehicle 14. In the embodiment shown, the thermal conductor is copper, such as powderized copper. In that regard, the thermal conductor may be mixed or blended with a carrier, such as acetone, to then be mixed with the resin, as will be described in further detail below. The thermal conductor may be any other suitable thermally conductive material, such as aluminum, zinc, iron, metal fibers, etc. To this end, the lubricant, such as PTFE, may further reduce temperature generation between surfaces of the mesh material 46 of the ride vehicle 14 and the slide surface 18, thereby resulting in an improved (i.e., reduced) and consistent coefficient of friction therebetween.

The hardening or curing agent operates as a catalyst to cure the dry lubricant material to the slide surface 18 to form the permanent coating 34 described above. In that regard, the hardening agent may be an anhydride-based, amine-based, polyamide, aliphatic or cycloaliphatic hardening agent, and may comprise amines such as aliphatic amines, for example, acids, acid anhydrides, phenols, alcohols or thiols, for example. To this end, the hardening agent may be the Steelflex #9X Hardener commercially available from Fasco Epoxies Inc (Fort Pierce, FL), for example.

In one embodiment, the composition of the dry lubricant material comprises the following: (i) 50% to 74% by weight of a resin, such as a silicon-based epoxy resin, (ii) 5% to 15% by weight of a lubricant, such as PTFE, (iii) 1% to 5% by weight of a thermal conductor, such as copper, and (iv) 20% to 30% by weight of a hardening or curing agent, such as an anhydride-based or amine-based hardener. In an alternative embodiment, the dry lubricant material composition may comprise the following: (i) 30% to 54% by weight of a resin, such as a silicon-based epoxy resin, (ii) 5% to 15% by weight of a lubricant, such as PTFE, (iii) 1% to 5% by weight of a thermal conductor, such as copper, and (iv) 30% to 50% by weight of a hardening or curing agent, such as an anhydride-based or amine-based hardener. In another alternative embodiment, the dry lubricant material composition may comprise the following: (i) 20% to 30% by weight of a resin, such as a silicon-based epoxy resin, (ii) 30% to 50% by weight of a lubricant, such as PTFE, (iii) 1% to 5% by weight of a thermal conductor, such as copper, and (iv) 20% to 30% by weight of a hardening or curing agent, such as an anhydride-based or amine-based hardener. However, depending on the desired drying and solidification time for the coating 34, as little as 10%, or as much as 50% by weight of the hardening or curing agent may be used in the above-described embodiments.

In another embodiment, the composition of the dry lubricant material comprises the following: (i) 50% to 74% by weight of a resin, such as a PTFE-based epoxy resin, (ii) 5% to 15% by weight of a lubricant, such as silicone, (iii) 1% to 5% by weight of a thermal conductor, such as copper, and (iv) 20% to 30% by weight of a hardening or curing agent, such as an anhydride-based or amine-based hardener. In an alternative embodiment, the dry lubricant material composition may comprise the following: (i) 30% to 54% by weight of a resin, such as a PTFE-based epoxy resin, (ii) 5% to 15% by weight of a lubricant, such as silicone, (iii) 1% to 5% by weight of a thermal conductor, such as copper, and (iv) 30% to 50% by weight of a hardening or curing agent, such as an anhydride-based or amine-based hardener. In another alternative embodiment, the dry lubricant material composition may comprise the following: (i) 20% to 30% by weight of a resin, such as a silicon-based epoxy resin, (ii) 30% to 50% by weight of a lubricant, such as silicone, (iii)

1% to 5% by weight of a thermal conductor, such as copper, and (iv) 20% to 30% by weight of a hardening or curing agent, such as an anhydride-based or amine-based hardener. However, depending on the desired drying and solidification time for the coating 34, as little as 10%, or as much as 50% by weight of the hardening or curing agent may be used in the above-described embodiments.

The dry lubricant material according to the present invention is prepared by mixing the components together using any conventional mixing apparatus, such as a powered mixer or stirrer, for example. In that regard, the lubricant and the thermal conductor are mixed into or blended into a solvent carrier, such as acetone, to form a first intermediate mixture. The first intermediate mixture is then mixed or blended into the resin to form a second intermediate mixture. The second intermediate mixture is then mixed or blended with the hardening or curing agent to form the dry lubricant material which can then be applied to the slide surface 18. To this end, the hardening or curing agent is mixed or blended into the second intermediate mixture immediately prior to applying the dry lubricant material to the slide surface 18 of a formed slide 12. To this end, the hardening agent may be mixed or blended into the second intermediate mixture 30 minutes prior to the dry lubricant material being applied to the slide surface 18, for example.

The dry lubricant material may be applied to the slide surface 18 of a formed slide 12 by spraying, rolling, roller coating, or brushing the dry lubricant material onto the slide surface 18 to form the coating 34. Once the dry lubricant material is applied to the slide surface 18, the dry lubricant material is let to cure to form the dry coating 34 having a specific thickness T. Curing of the dry lubricant material includes air drying of the material. In that regard, the dry lubricant material may be partially cured after 4 hours of air drying, and fully cured after 48 hours of air drying, for example. During curing of the dry lubricant material, volatile components such as the acetone carrier, for example, are removed from the dry lubricant material via evaporation. The slide surface 18 may be wiped clean or otherwise pretreated to improve the adhesion and the life of the dry lubricant material and coating 34.

Figure 3:
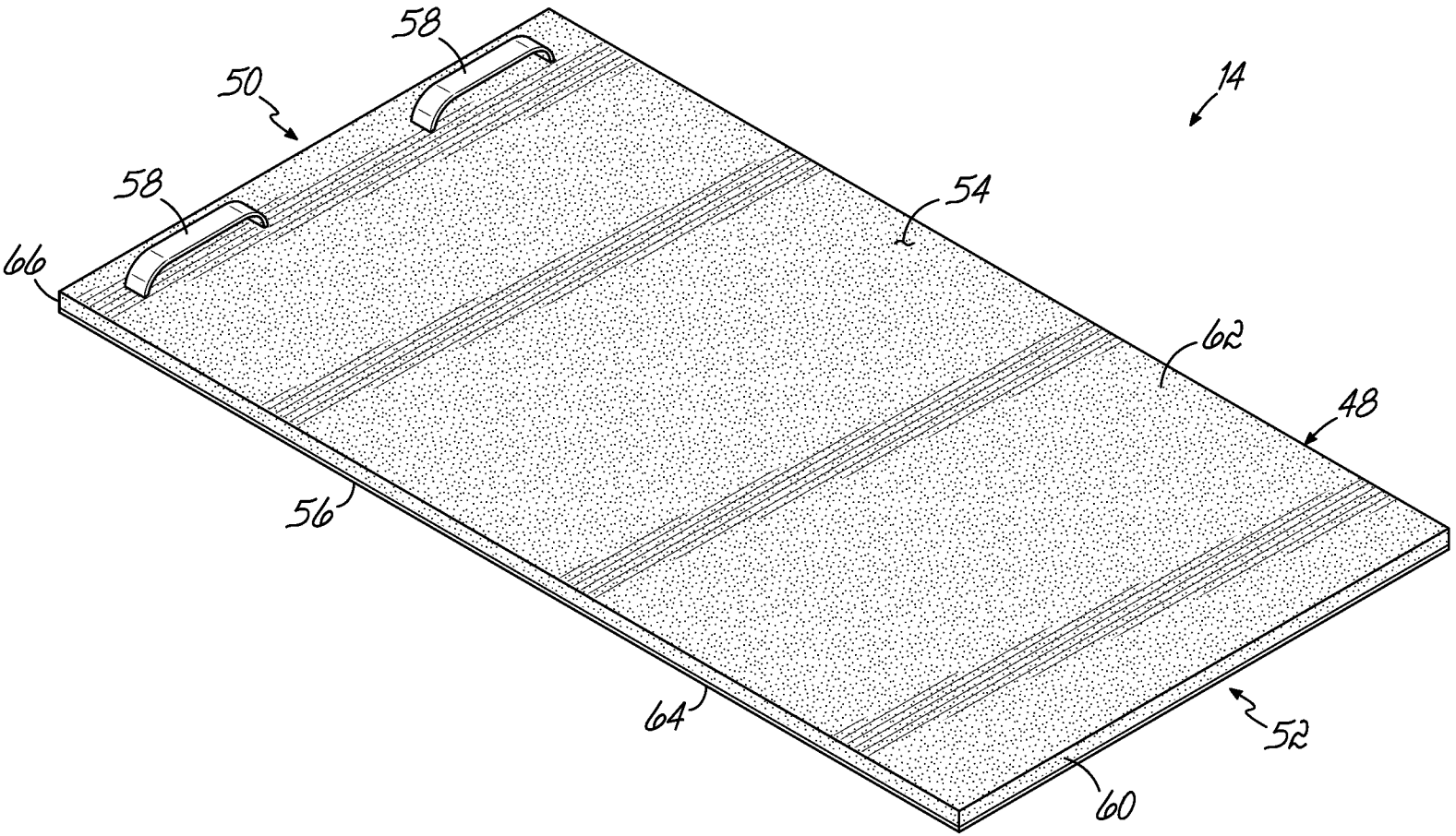
FIG. 3 is a perspective view of a ride vehicle having a bottom surface formed of a mesh material according to an embodiment of the present invention.
Figure 4:
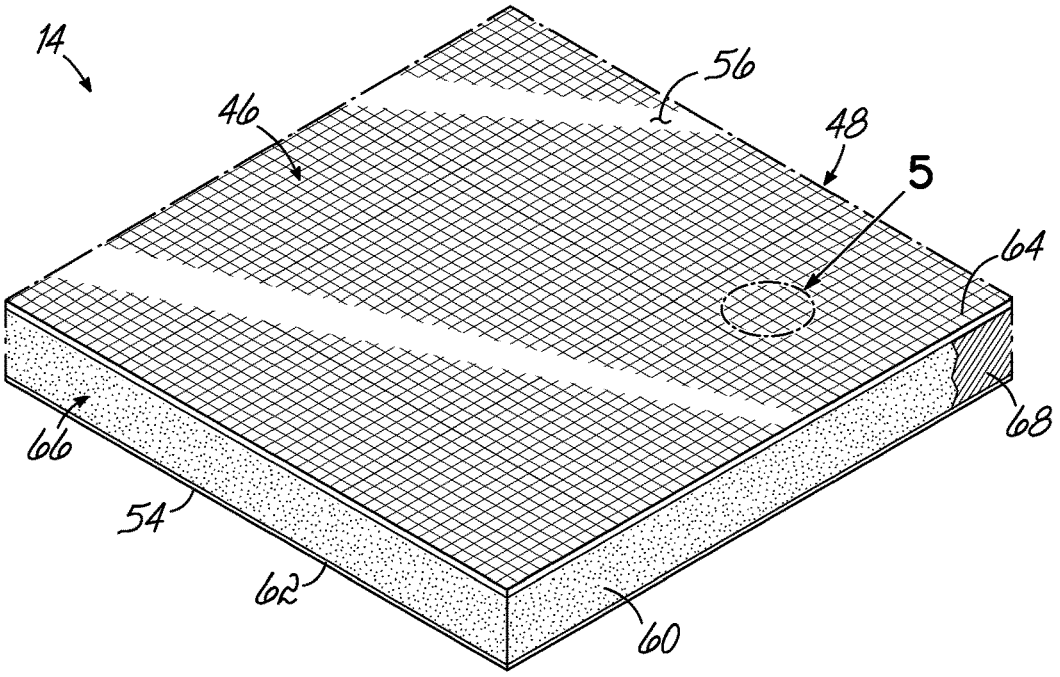
FIG. 4 is an enlarged perspective view of a section of the ride vehicle of FIG. 4, illustrating the bottom surface of the ride vehicle.

Having now described certain details of the dry lubricant material which forms the dry lubricant coating 34 on the slide surface 18 of the slide 12 of the slide system 10, details of the ride vehicle 14 of the slide system 10 that incorporates a mesh 46 material in accordance with an embodiment of the present invention will now be described. As shown in FIGS. 3-4, the ride vehicle 14, which may otherwise be referred to as a slide mat, includes a flexible elongate body 48 that extends between a first end 50 and an opposite second end 52 to define a length of the ride vehicle 14. The first end 50 of the body 48 may form the front of the ride vehicle 14, for example. The body 48 further includes a top surface 54 and an opposite bottom surface 56. The top surface 54 is configured to be in contact with a rider and includes a pair of handles 58 at the first end 50 configured to be gripped by the rider. The bottom surface 56 is configured to engage the slide surface 18 and includes the mesh material 46 as will be described in further detail below. While the exemplary ride vehicle 14 shown is generally rectangular in shape, the ride vehicle 14 may include other polygonal shapes or circular shapes, for example.

As shown in FIGS. 3 and 4, the body 48 of the ride vehicle 14 is defined by a flexible central core 60 that is sandwiched between an outer fabric layer 62 and a mesh layer 64 formed of the mesh material 46. The fabric layer 62 forms the top surface 54 of the ride vehicle 14 and the mesh layer 64 forms the bottom surface 56 of the ride vehicle 14. The fabric layer 62 may be formed of a synthetic material, such as Neoprene, for example, or any other suitable wear-resistant material. The fabric layer 62 and the mesh layer 64 may be coupled together at a seam that extends around a sidewall 66 of the ride vehicle 14, for example. The central core 60 of the ride vehicle 14 is formed of a flexible material, such as a composite foam pad, for example. The central core 60 may have a thickness (i.e., measured along a height of the sidewall 66 of the ride vehicle 14) of approximately 0.25 inches. The central core 60, which generally forms the shape of the body 48 of the ride vehicle 14, may be enclosed or surrounded with a fabric liner 68 (FIG. 4) for increased wear resistance. To this end, the fabric liner 68 is positioned between the central core 60 and the fabric layer 62 and the mesh layer 64.

Figure 5:
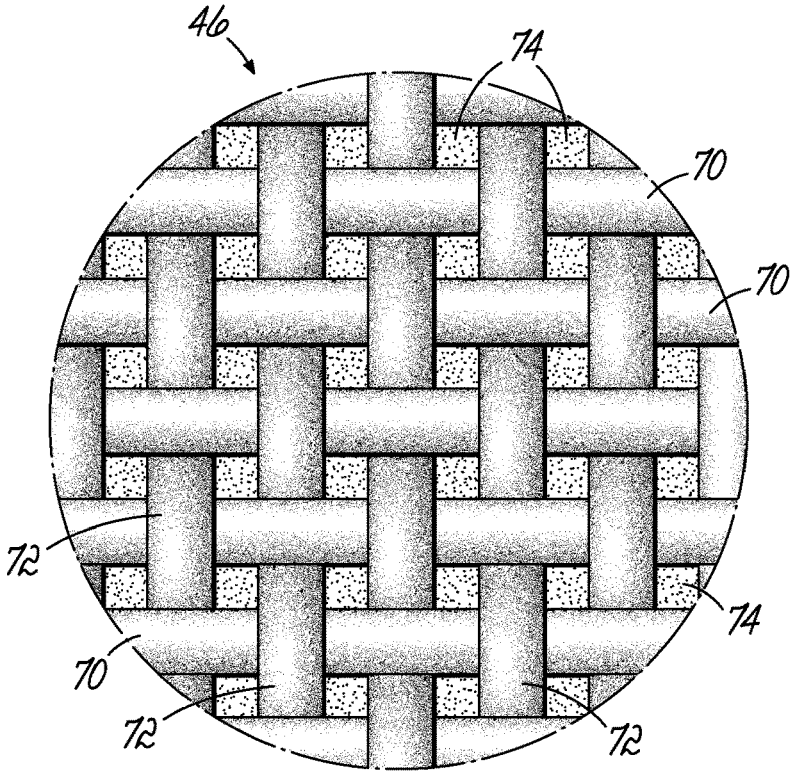
FIG. 5 is an enlarged view of a portion "5" of the bottom surface of the ride vehicle shown in FIG. 4, illustrating characteristics of the mesh material.

Referring now to FIG. 5, an enlarged view of a portion 5 of the mesh layer 64 of FIG. 4 is shown illustrating characteristics of the mesh material 46. In that regard, the mesh material 46 is a woven mesh that comprises a weave of threads formed of monofilament synthetic fibers. In particular, the mesh material 46 includes a number of warp threads 70 which extend generally perpendicular to a number of weft threads 72 to form a plurality of interstitial openings 74 therebetween. In the embodiment shown, each of the interstitial openings 74 is generally square in shape and may generally form a 300 micron opening, for example, and the open area of the mesh material 46 may be within a range of between about 35% to about 50%, and particularly about 44%. However, the interstitial openings 74 may be within a range of between about 45 micron to about 1200 micron, for example, and the open area of the mesh material 46 may be within a range of between about 25% to about 65%, for example. As used herein relative to the size of the interstitial openings 74 and the open area of the mesh material 46, "about" is intended to mean+/−10%. To this end, the orientation of the warp and weft threads 70, 72 and the interstitial openings 74 formed therebetween defines a permeability of the mesh material 46. The permeability of the mesh material 46 in the embodiment shown, which is a measurement of fluid flow through the mesh material 46, typically measured in cubic feet per minute (cfm) at 0.5 inch water pressure, is within a range of between about 550 to about 622 cfm of air per minute. As used herein relative to the permeability of the mesh material 46, "about" is intended to mean+/−10%. The open area of the mesh material 46 refers to the total percentage of open space or voids in the mesh structure. It represents the portion of the mesh material 46, and the bottom surface 56 of the ride vehicle 14, that is not occupied by solid material such as threads.

In the embodiment shown, the warp and weft threads 70, 72 of the mesh material 46 are formed of a polyamide monofilament structure, such as Nylon 6 (otherwise referred to as polycaprolactam), which proved during testing to yield the lowest coefficient of friction in combination with the dry lubricant coating 34. However, the warp and weft threads 70, 72 may be formed from other types of polyamide monofilament structures, or other materials such as polyvinylidene fluoride, polyester, polyethylene, polypropylene, PTFE, or UHMWPE, for example.

With continued reference to FIG. 5, the diameter of each warp thread 70 may be within a range of between about 0.1 mm to about 0.6 mm, and particularly between about 0.2 mm to about 0.4 mm, and even more particularly about 0.3 mm (i.e., 300 micron). The diameter of each weft thread 72 may be within a range of between about 0.1 mm to about 0.6 mm, and particularly between about 0.2 mm to about 0.4 mm, and even more particularly about 0.3 mm (i.e., 300 micron). As used herein relative to the diameter of the warp and weft threads 70, 72, "about" is intended to mean+/−5%. The mesh fabric 46 is arranged such that the warp threads 70 extend along the body 48 of the ride vehicle 14 in a lengthwise direction (i.e., in a direction between the first end 50 and the second end 52 of the body 48 of the ride vehicle 14). In that regard, the weft threads 72 are configured to extend along the body 48 of the ride vehicle 14 in a widthwise direction. In the embodiment shown, the density of the warp threads 70 is approximately 22 threads per centimeter of mesh material 46. The density of the weft threads 72 is approximately 13 threads per centimeter of mesh material 46.

Figure 6:
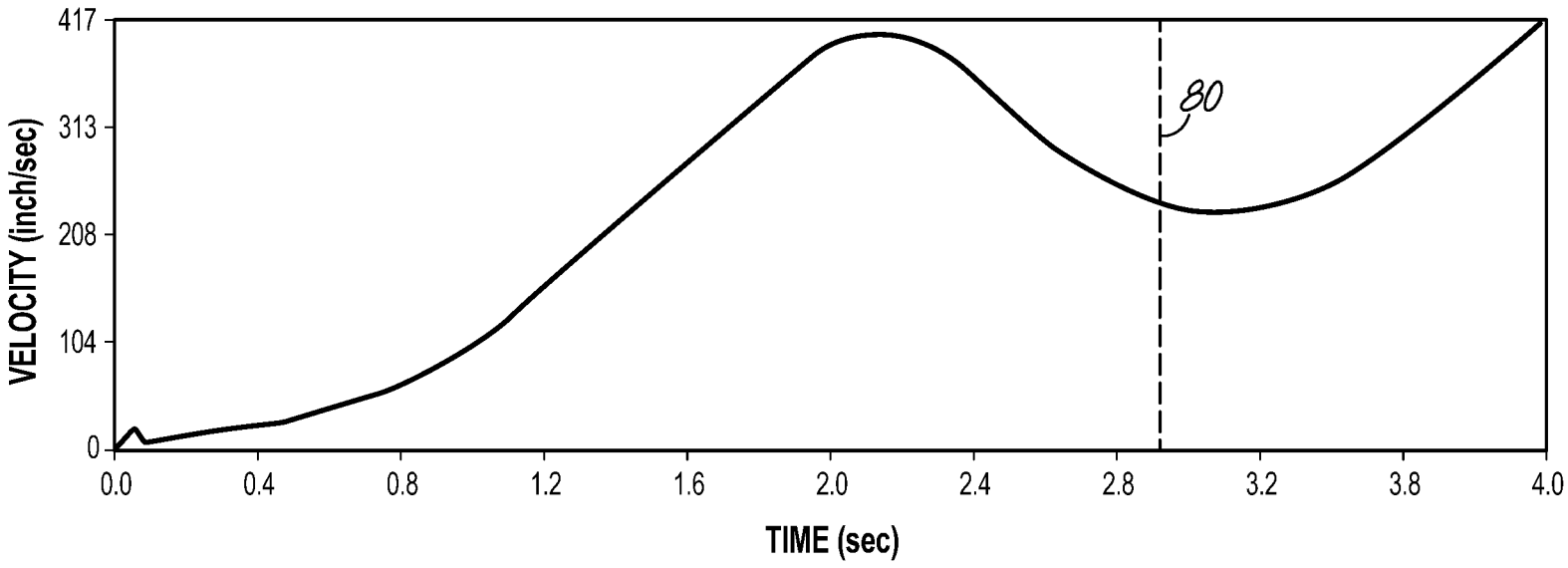
FIG. 6 is a chart illustrating a performance simulation of the slide system of FIG. 1.

In developing the dry lubricant material and the mesh material 46, performance tests and analysis was performed using a model of the slide system 10 described above. In particular, SOLIDWORKS Simulations of the model were ran to determine the performance of the slide system 10. The results of one of the SOLIDWORKS Simulations is shown in FIG. 6. In that regard, a rider of average weight (i.e., 160 lbs) descending down the slide 12 on a ride vehicle 14, with a kinetic coefficient of friction of 0.09 between the mesh material 46 of the ride vehicle 14 and the dry lubricant coating 34 of the slide surface 18, will exit the bottom exit 22 of the slide 12 after approximately 2.9 seconds, as indicated by the dashed vertical line 80. The rider will achieve a maximum velocity of approximately 415 inches per second and exits the slide 12 at a velocity of approximately 235 inches per second.

The coefficient of friction between surfaces of the mesh material 46 and the slide surface 18 may be determined using the American Society for Testing and Materials International (ASTM) Coefficient of Friction ASTM D1894 standard test method (July, 2023), which may be used to determine both kinetic (moving) and static (starting) coefficient of friction of one surface being dragged across another. The ASTM D1894 test method can be found at www.astm.org. For the ASTM D1894 test, the material specimen is attached to a sled of defined weight. This sled is pulled across another surface at a speed of 150 mm/minute. The force required to start the sled is measured to get the static friction. The force required to maintain the motion of the sled is measured to get the kinetic friction.

Figure 7B:
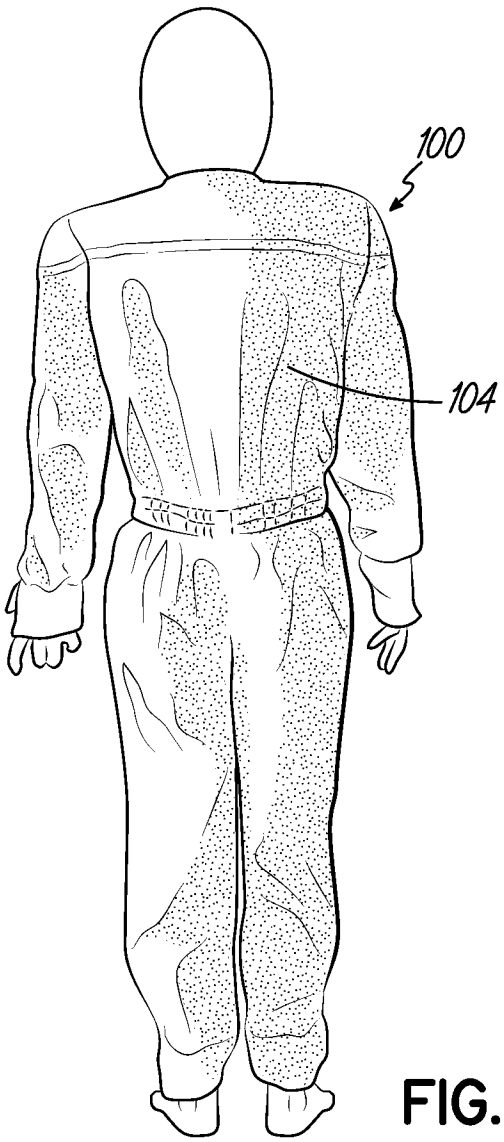
FIGS. 7A-7B are views of a body suit formed of the mesh material in accordance with another embodiment of the present invention.
Figure 7A:
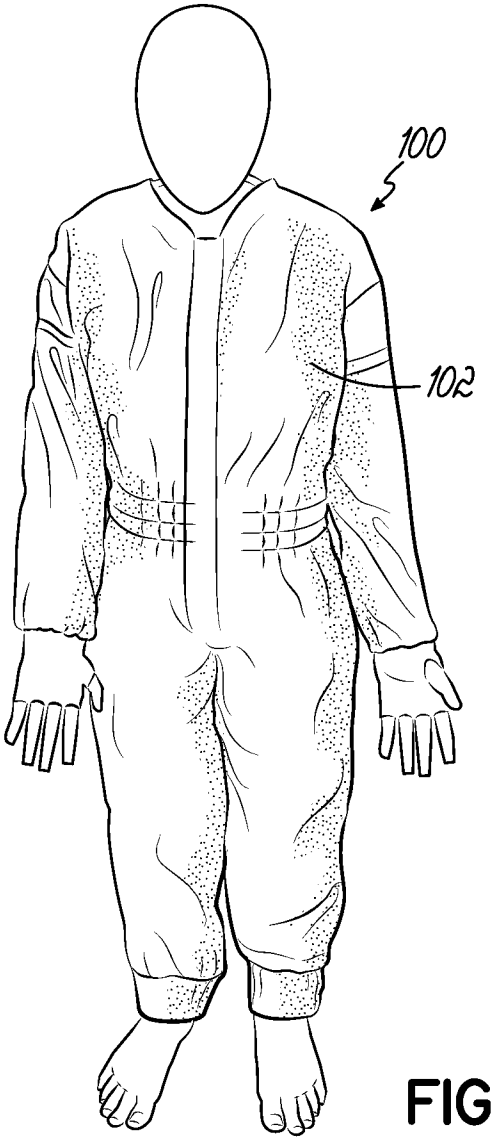

With reference now to FIGS. 7A-7B, a ride vehicle in the form of a body suit 100 is shown in accordance with an embodiment of the present invention. The body suit 100 is configured to be worn by a rider and is formed of the mesh material 46 described above. The body suit 100 is configured to cover the arms, legs, and torso of a rider, for example. In particular, a front 102 and a back 104 of the body suit 100 may be formed of the mesh material 46, as shown. That way, when a rider slides down the slide 12, either on their back or front, the mesh material 46 is positioned between the rider and the slide surface 18 of the slide 12. In an alternative embodiment, the back 104 or the front 102 may be the only portion of the body suit 100 formed of the mesh material 46. To this end, while aspects of the present invention are shown and described in the context of certain types or configurations of ride vehicles, it will be understood that the same inventive concepts related to aspects of the mesh material 46 may be implemented with different ride vehicle designs, such as a sack configured to contain the rider, for example. To this end, the drawings are not intended to be limiting.

While the invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A recreational slide system, comprising:

a slide including a slide body with a non-wet lubricated slide surface that extends between a top entrance of the slide and a bottom exit of the slide; and a ride vehicle configured to support a rider down the slide, the ride vehicle including a top surface configured to contact the rider and a mesh layer that forms a bottom surface configured to contact the slide surface;

wherein a coefficient of friction between the mesh layer of the ride vehicle and the non-wet lubricated slide surface is within a range of between about 0.03 to about 0.2.

2. The recreational slide system of claim 1, wherein the coefficient of friction is kinetic coefficient of friction.

3. The recreational slide system of claim 1, wherein the slide surface includes a dry lubricant material.

4. The recreational slide system of claim 3, wherein the dry lubricant material comprises a dry lubricant coating over the slide surface.

5. The recreational slide system of claim 4, wherein the dry lubricant coating includes a thickness that is within a range of between about 1 micron to about 5 micron.

6. The recreational slide system of claim 4, wherein the slide body includes a base wall and a pair of sidewalls and the dry lubricant coating covers a sliding surface of the base wall.

7. The recreational slide system of claim 6, wherein the dry lubricant coating covers at least a portion of the pair of sidewalls.

8. The recreational slide system of claim 3, wherein the dry lubricant material includes a resin, a lubricant, a thermal conductor, and a hardener.

9. The recreational slide system of claim 8, wherein the dry lubricant material applied to the slide surface comprises:

20% to 30% by weight of the resin;

30% to 50% by weight of the lubricant;

1% to 5% by weight of the thermal conductor; and

20% to 30% by weight of the hardener.

10. The recreational slide system of claim 9, wherein the resin comprises a silicon-based epoxy resin.

11. The recreational slide system of claim 9, wherein the lubricant comprises polytetrafluoroethylene.

12. The recreational slide system of claim 9, wherein the thermal conductor comprises copper.

13. The recreational slide system of claim 9, wherein the hardener comprises an anhydride-based or an amine-based catalyst.

14. The recreational slide system of claim 1, wherein the mesh layer of the ride vehicle comprises a weave of threads formed of monofilament synthetic fibers.

15. The recreational slide system of claim 14, wherein the monofilament synthetic fibers comprise a polyamide monofilament structure.

16. The recreational slide system of claim 14, wherein the weave of threads comprises a plurality of weft threads each having a thread diameter within a range of between 0.1 mm to 0.6 mm and a plurality of warp threads each having a thread diameter within a range of between about 0.1 mm to about 0.6 mm.

17. The recreational slide system of claim 14, wherein the mesh layer includes a plurality of interstitial openings that define an open area of the mesh layer, wherein the open area of the mesh layer is within a range of between about 35% to about 50%.

18. A non-wet lubricated recreational slide, comprising:

a slide body with a slide surface that extends between a top entrance of the slide and a bottom exit of the slide, the slide surface including a dry lubricant coating comprising a resin, a lubricant, a thermal conductor, and a hardener, wherein the thermal conductor comprises copper.

19. The non-wet lubricated recreational slide of claim 18, wherein the dry lubricant coating comprises:

20% to 30% by weight of the resin;

30% to 50% by weight of the lubricant;

1% to 5% by weight of the thermal conductor; and

20% to 30% by weight of the hardener.

20. The non-wet lubricated recreational slide of claim 18, wherein the slide body includes a base wall and a pair of sidewalls and the dry lubricant coating covers a sliding surface of the base wall.

21. The non-wet lubricated recreational slide of claim 20, wherein the dry lubricant coating covers at least a portion of a sliding surface of the pair of sidewalls.

22. A ride vehicle configured to support a rider down a non-wet lubricated recreational slide, the ride vehicle comprising:

an elongate body that extends between a first end and an opposite second end, the body including a central core positioned between a top surface of the ride vehicle and a woven mesh layer that forms a bottom surface of the ride vehicle that is configured to contact the non-wet lubricated recreational slide;

wherein the mesh layer includes a plurality of interstitial openings that define an open area of the mesh layer, wherein the open area of the mesh layer is within a range of between about 35% to about 50%.

23. The ride vehicle of claim 22, wherein the woven mesh layer comprises a weave of threads formed of monofilament synthetic fibers.

24. The ride vehicle of claim 22, wherein the monofilament synthetic fibers comprise a polyamide monofilament structure.

25. A ride vehicle configured to support a rider down a non-wet lubricated recreational slide, the ride vehicle comprising:

an elongate body that extends between a first end and an opposite second end, the body including a central core positioned between a top surface of the ride vehicle and a woven mesh layer that forms a bottom surface of the ride vehicle that is configured to contact the non-wet lubricated recreational slide;

wherein the mesh layer includes a plurality of weft threads each having a thread diameter within a range of between 0.1 mm to 0.6 mm and a plurality of warp threads each having a thread diameter within a range of between about 0.1 mm to about 0.6 mm.

26. The ride vehicle of claim 22, wherein the central core is surrounded by a fabric liner that is positioned between the central core and the fabric layer and the woven mesh layer.

27. A recreational slide system, comprising:

the ride vehicle of claim 22; and a slide including a slide body with a non-wet lubricated slide surface that extends between a top entrance of the slide and a bottom exit of the slide;

wherein a coefficient of friction between the mesh layer of the ride vehicle and the non-wet lubricated slide surface is within a range of between about 0.03 to about 0.2.

28. The recreational slide system of claim 27, wherein the coefficient of friction is kinetic coefficient of friction.

* * * * *